US011033865B2

(12) United States Patent
Son et al.

(10) Patent No.: US 11,033,865 B2
(45) Date of Patent: Jun. 15, 2021

(54) DISSOLUTION MIXER

(71) Applicant: LG CHEM, LTD., Seoul (KR)

(72) Inventors: Jin-Young Son, Daejeon (KR); Hwi-Soo Yang, Daejeon (KR); Woo-Ha Kim, Daejeon (KR); Sang-Hoon Choy, Daejeon (KR)

(73) Assignee: LG Chem, Ltd.

( * ) Notice: Subject to any disclaimer, the term of this patent is extended or adjusted under 35 U.S.C. 154(b) by 335 days.

(21) Appl. No.: 16/094,156

(22) PCT Filed: Nov. 30, 2017

(86) PCT No.: PCT/KR2017/013960
§ 371 (c)(1),
(2) Date: Oct. 16, 2018

(87) PCT Pub. No.: WO2018/128276
PCT Pub. Date: Jul. 12, 2018

(65) Prior Publication Data

US 2019/0134572 A1 May 9, 2019

(30) Foreign Application Priority Data

Jan. 3, 2017 (KR) ..... 10-2017-0000872

(51) Int. Cl.
*B22C 5/00* (2006.01)
*B01F 1/00* (2006.01)
(Continued)

(52) U.S. Cl.
CPC ..... *B01F 1/0038* (2013.01); *B01F 1/0011* (2013.01); *B01F 7/007* (2013.01);
(Continued)

(58) Field of Classification Search
None
See application file for complete search history.

(56) References Cited

U.S. PATENT DOCUMENTS 2,928,661 A * 3/1960 Maclaren ..... C02F 3/207 261/24
6,106,588 A 8/2000 Skibo et al.
(Continued)

FOREIGN PATENT DOCUMENTS

CN 2180321 Y 10/1994
CN 201815309 U 5/2011
(Continued)

OTHER PUBLICATIONS

Machine Translation of JP-2002045670-A description, Feb. 2002 (Year: 2002).*
(Continued)

*Primary Examiner* — Anshu Bhatia
*Assistant Examiner* — Greg Huan
(74) *Attorney, Agent, or Firm* — Lerner, David, Littenberg, Krumholz & Mentlik, LLP

(57) ABSTRACT

Disclosed is a dissolution mixer, which includes: a dissolution bath configured to accommodate a powder and a solvent for dissolving the powder; a powder input unit located at an outer side of the dissolution bath; an impeller installed to be rotatable inside the dissolution bath; and an anchor located inside the dissolution bath and having a passage of the powder inputted by the powder input unit and a powder spouting hole connected to the passage.

10 Claims, 3 Drawing Sheets

(51) Int. Cl.

| | |
|---|---|
| ***B01F 15/02*** | (2006.01) |
| ***B01F 7/22*** | (2006.01) |
| ***B01F 7/00*** | (2006.01) |
| ***B01F 7/16*** | (2006.01) |

(52) U.S. Cl.

CPC ..... *B01F 7/00266* (2013.01); *B01F 7/166* (2013.01); *B01F 7/1625* (2013.01); *B01F 7/22* (2013.01); *B01F 15/026* (2013.01)

(56) References Cited

U.S. PATENT DOCUMENTS

| | | | | |
|---|---|---|---|---|
| 6,866,411 | B1 | 3/2005 | Stelzer et al. | |
| 2011/0134717 | A1 | 6/2011 | Furuichi et al. | |
| 2018/0178176 | A1 * | 6/2018 | Morinaga | B01F 7/22 |
| 2019/0134572 | A1 | 5/2019 | Son et al. | |

FOREIGN PATENT DOCUMENTS

| | | | | | |
|---|---|---|---|---|---|
| CN | 202638358 | U | | 1/2013 | |
| CN | 204380613 | U | | 6/2015 | |
| CN | 107245544 | A | | 10/2017 | |
| CN | 208115559 | U | | 11/2018 | |
| EP | 0057968 | A2 | | 8/1982 | |
| EP | 0335096 | A2 | * | 10/1989 | B01F 7/00208 |
| EP | 2283916 | A1 | | 2/2011 | |
| FR | 2767720 | A1 | | 3/1999 | |
| JP | 5-33156 | U | | 4/1993 | |
| JP | H0533156 | U | | 4/1993 | |
| JP | 2002-45670 | A | | 2/2002 | |
| JP | 2002045670 | A | * | 2/2002 | |
| JP | 2003-119509 | A | | 4/2003 | |
| JP | 2003340253 | A | | 12/2003 | |
| JP | 2011-189310 | A | | 9/2011 | |
| JP | 2011189310 | A | * | 9/2011 | |
| JP | 2015-171698 | A | | 10/2015 | |
| KR | 10-0851926 | B1 | | 8/2008 | |
| KR | 10-1209520 | B1 | | 12/2012 | |
| KR | 10-2015-0065338 | A | | 6/2015 | |
| KR | 10-1613318 | B1 | | 4/2016 | |
| WO | WO 2012/028291 | A1 | | 3/2012 | |
| WO | WO-2012028291 | A1 | * | 3/2012 | B01F 5/221 |

OTHER PUBLICATIONS

Machine Translation of JP-2011189310-A description, Sep. 2011 (Year: 2011).*

Machine Translation of EP-0335096-A2 description, Oct. 1989 (Year: 1989).*

Machine Translation of EP-0335096-A2 abstract, Oct. 1989 (Year: 1989).*

International Search Report issued in PCT/KR2017/013960 (PCT/ISA/210), dated Mar. 28, 2018.

Ohinese Search Report for Application No. 2017800281350 dated Aug. 21, 2020, 2 pages.

Chinese Search Report for Application No. CN201780028135.0 dated Mar. 17, 2021.

* cited by examiner

DISSOLUTION MIXER

TECHNICAL FIELD

The present disclosure relates to a dissolution mixer, and more particularly, to a dissolution mixer designed to input powder in a dispersed form so that the power may be easily dissolved.

The present application claims priority to Korean Patent Application No. 10-2017-0000872 filed on Jan. 3, 2017 in the Republic of Korea, the disclosures of which are incorporated herein by reference.

BACKGROUND ART

Carboxylmethyl cellulose (CMC) is currently used for dispersion and phase stabilization of an aqueous negative electrode of a lithium secondary battery and is used in a solution state by performing the dissolution and filtering processes so that any issue in the battery manufacturing process caused by the existence of a specific undissolved material peculiar to natural materials is solved.

However, during the process in which CMC is dissolved into a solution state, if CMC powder is input into a dissolution bath in a lump, undissolved material may be excessively generated due to particle agglomeration. Thus, when a worker inputs the powder, it is necessary for the user to input the powder dividedly several times, and also the power should be applied as thinly as possible when being inputted, thereby giving difficulties in the process.

Further, if a worker directly inputs CMC powder in a divided manner as above, a mixer should be opened whenever the power is inputted, and thus the risk of contamination of the material is very high. In addition, the risk to the worker is also great, and it is urgently required to improve the quality of the material.

This requirement is not limited to the process of inputting CMC powder but is also applied to a process of inputting another kind of powder, which is applied for manufacturing a secondary battery.

DISCLOSURE

Technical Problem

The present disclosure is designed to solve the problems of the related art, and therefore the present disclosure is directed to improving a structure of a mixer to minimize the generation of undissolved material due to particle agglomeration, which may occur when powder is dissolved, to improve the quality of the material by eliminating the risk of contamination of the material, which may occur when the power is inputted, and to improve the productivity by automating the powder inputting process.

However, the technical problem to be solved by the present disclosure is not limited to the above, and other objects not mentioned herein will be clearly understood by those skilled in the art from the following present disclosure.

Technical Solution

In one aspect of the present disclosure, there is provided a dissolution mixer, comprising: a dissolution bath configured to accommodate a powder and a solvent for dissolving the powder; a powder input unit located at an outer side of the dissolution bath; an impeller installed to be rotatable inside the dissolution bath; and an anchor located inside the dissolution bath and having a passage of the powder inputted by the powder input unit and a powder spouting hole connected to the passage.

The dissolution mixer may further comprise a dissolved material discharging unit connected to a lower portion of the dissolution bath.

The anchor may have a rectangular frame shape.

The anchor may include: an upper frame connected to the powder input unit; a lower frame located below the upper frame; and a pair of connection frames configured to connect the upper frame and the lower frame.

The powder spouting hole may be formed in the lower frame.

A center portion of the lower frame may have a donut shape.

The powder spouting hole may be formed in both the center portion of the lower frame and a region of the lower frame other than the center portion.

The powder spouting hole may be formed only in the center portion of the lower frame.

The anchor may be installed to be rotatable inside the dissolution bath.

A rotating direction of the anchor may be identical to a rotating direction of the impeller.

A rotating speed of the anchor may be slower than a rotating speed of the impeller.

The impeller and the anchor may rotate based on the same rotation shaft.

Advantageous Effects

According to an embodiment of the present disclosure, by improving a structure of a mixer, it is possible to minimize the generation of undissolved material due to particle agglomeration, which may occur when powder is dissolved, and to improve the quality of the material by eliminating the risk of contamination of the material, which may occur when the power is inputted.

According to another embodiment of the present disclosure, it is possible to improve the productivity by automating the powder inputting process.

DESCRIPTION OF DRAWINGS

The accompanying drawings illustrate a preferred embodiment of the present disclosure and together with the foregoing disclosure, serve to provide further understanding of the technical features of the present disclosure, and thus, the present disclosure is not construed as being limited to the drawing.

BEST MODE

Hereinafter, preferred embodiments of the present disclosure will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present disclosure on the basis of the principle that the inventor is allowed to define terms appropriately for the best explanation. Therefore, the description proposed herein is just a preferable example for the purpose of illustrations only, not intended to limit the scope of the disclosure, so it should be understood that other equivalents and modifications could be made thereto without departing from the scope of the disclosure.

A structure of a dissolution mixer according to an embodiment of the present disclosure will be described with reference to FIGS. 1 to 4.

Figure 1:
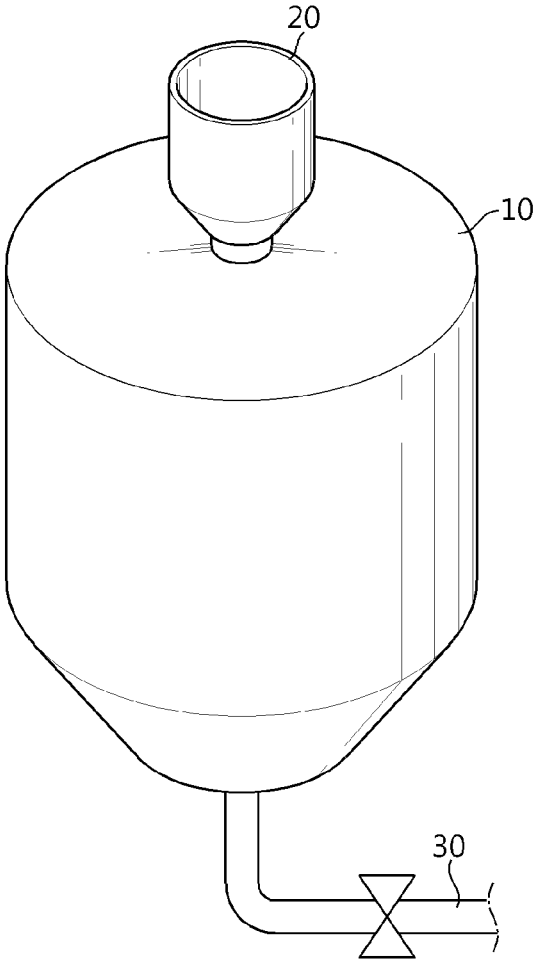
FIG. 1 is a perspective view showing a dissolution mixer according to an embodiment of the present disclosure.
Figure 2:
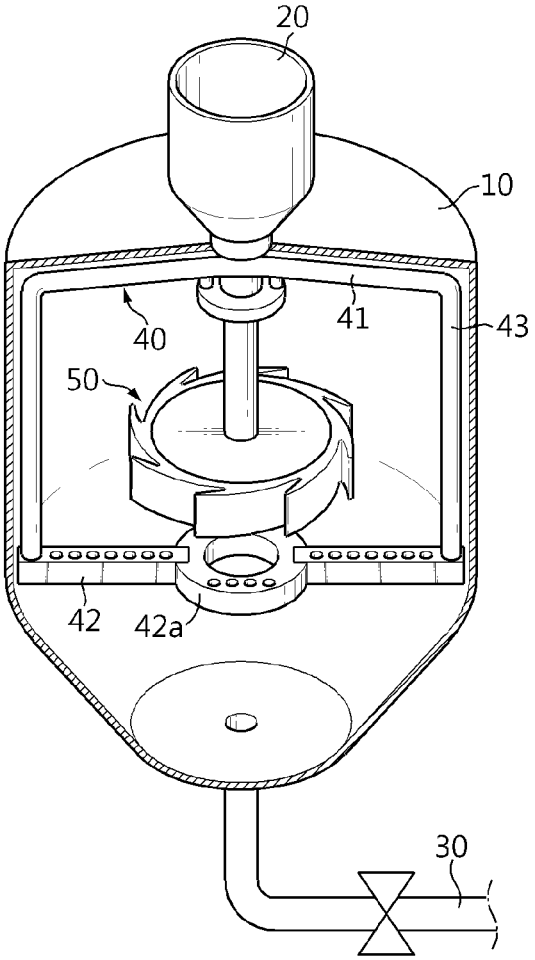
FIG. 2 is a diagram showing an inner structure of the dissolution mixer according to an embodiment of the present disclosure.
Figure 3:
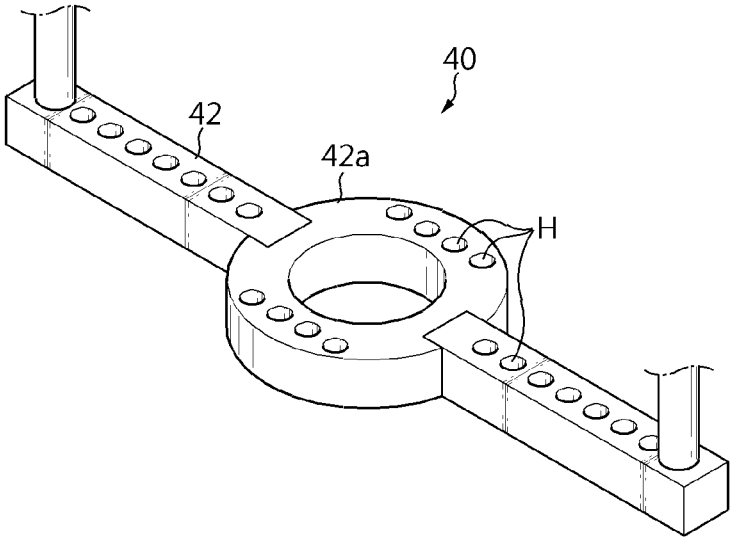
FIGS. 3 and 4 are diagrams showing examples of an anchor employed in the present disclosure.
Figure 4:
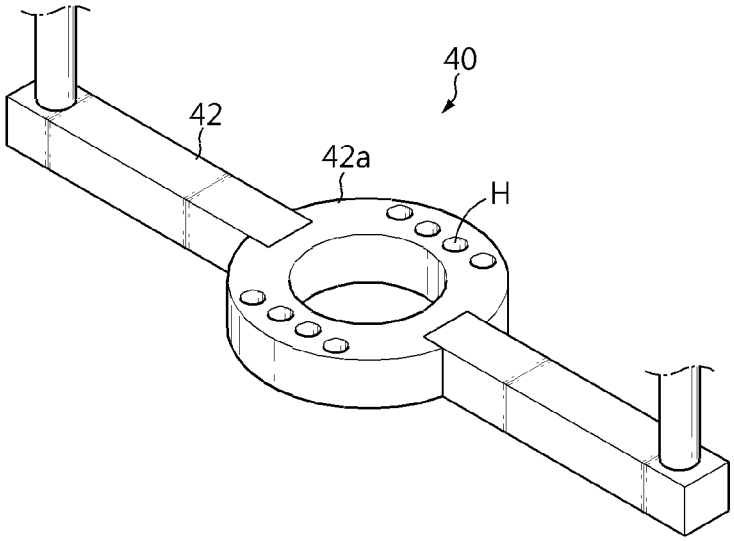

FIG. 1 is a perspective view showing a dissolution mixer according to an embodiment of the present disclosure, FIG. 2 is a diagram showing an inner structure of the dissolution mixer according to an embodiment of the present disclosure, and FIGS. 3 and 4 are diagrams showing examples of an anchor employed in the present disclosure.

First, referring to FIGS. 1 and 2, a dissolution mixer according to an embodiment of the present disclosure may include a dissolution bath 10, a powder input unit 20, an anchor 40 and an impeller 50, and may further include a dissolved material discharging unit 30.

The dissolution mixer according to an embodiment of the present disclosure is used for mixing carboxylmethyl cellulose (CMC) powder with a solvent such as water to make a dissolved material. However, the present disclosure is not limited thereto, and the dissolution mixer may also be used for a mixing process of various kinds of powder in addition to CMC powder.

The dissolution bath 10 has a hollow cylindrical shape and may accommodate a solvent such as water therein. The dissolution bath 10 may have a downwardly convex shape to have a cross-sectional area gradually narrowed in a lower direction, so that the dissolved material is easily discharged through a lower portion of the dissolution bath 10 after the mixing process is completed.

However, after the dissolved material is completely generated through the mixing process, the dissolved material does not necessarily have to be discharged through the lower portion of the dissolution bath but may be discharged through an upper portion of the dissolution bath. Thus, the lower portion of the dissolution bath 10 does not necessarily have the convex shape.

In addition, the dissolution bath 10 may have an opening so that the dissolved material may be discharged through the upper portion, and may include a cover installed to open or close the opening.

The powder input unit 20 may be connected to the inside of the dissolution bath 10 through the upper portion of the dissolution bath 10, and the powder may be inputted into the dissolution bath 10 through the powder input unit 20.

The impeller 50 is installed to rotate in a direction perpendicular to the ground, namely based on a rotary shaft extending in a vertical direction in FIGS. 1 and 2. As the impeller rotates in the dissolution bath 10, that the powder and the solvent inputted into the dissolution bath 10 may be mixed well.

The impeller 50 is preferably positioned in a width direction of the dissolution bath 10, namely at a center portion in a lateral direction based on FIGS. 1 and 2, for efficient mixing.

The anchor 40 is located inside the dissolution bath 10 and has a passage of the powder inputted by the powder input unit 20 and a powder spouting hole connected to the passage. The powder may be moved through the passage by applying a pressure at the input unit 20 or by making a vacuum in the inner space of the dissolution bath 10.

The anchor 40 has an approximately rectangular frame shape. Specifically, the anchor 40 may include an upper frame 41 connected to the powder input unit 20, a lower frame 42 positioned below the upper frame 41, and a pair of connection frames 43 connecting the upper frame and the lower frame.

An empty space serving as the passage through which the powder is movable as described above is formed inside the frame of the anchor 40, and a plurality of powder spouting holes H are formed in the lower frame 42.

The powder inputted by the powder input unit 20 is moved through the empty space formed inside the anchor 40, namely through the powder passage, and is supplied into the dissolution bath 10 through the powder spouting hole H when reaching the lower frame 42.

Referring to FIGS. 3 and 4, a center portion 42*a* of the lower frame 42 may have a donut shape with an empty central portion. Also, the powder spouting hole H may be formed in the entire lower frame 42 (see FIG. 3), but it is also possible that the powder spouting hole H is formed only in the center portion 42*a* having a donut shape (see FIG. 4).

This is to allow the powder to be spouted within a direct influence range of a vortex formed by the rotation of the impeller 50.

In order to spout the powder within the direct influence range of the vortex formed by the rotation of the impeller, it is preferred that the lower frame 42 is positioned lower than the impeller 50 and the powder spouting hole H is located in the upper portion of the lower frame 42 so that the powder is spouted upward.

In this case, the impeller 50 is rotated in a direction in which a vortex is generated below the impeller 50, and powder is spouted in a direction toward the generated vortex, thereby enabling more efficient mixing.

Further, in order to spout the powder within the direct influence range of the vortex generated by the impeller 50, it is preferable that a diameter of the center portion 42*a* is less than a diameter of the impeller 50.

Meanwhile, the anchor 40 may be installed to be rotatable for a more efficient mixing effect. In this case, the anchor 40 may rotate with respect to the rotary shaft extending in a direction perpendicular to the ground, similar to the impeller 50, and a rotating direction of the anchor 40 may be identical to a rotating direction of the impeller 50, and a rotating speed of the anchor 40 may be lower than a rotating speed of the impeller 50.

If the anchor 40 spouts the powder while directly rotating, the powder supplied through the same powder spouting hole H may not be supplied to the same position but the supplied location may be continuously changed. Thus, the possibility of generating undissolved material caused by particle agglomeration during the mixing process may be significantly lowered.

As described above, the dissolution mixer according to an embodiment of the present disclosure is designed to disperse and supply the powder through the powder spouting hole H formed in the anchor 40. Further, the powder spouting hole H is disposed at an appropriate position to give an improved mixing effect, thereby significantly lowering the generation of undissolved material caused by particle agglomeration.

The present disclosure has been described in detail. However, it should be understood that the detailed description and specific examples, while indicating preferred embodiments of the disclosure, are given by way of illustration only, since various changes and modifications within the scope of the disclosure will become apparent to those skilled in the art from this detailed description.

What is claimed is:

1. A dissolution mixer, comprising:

a dissolution bath configured to accommodate a powder and a solvent for dissolving the powder;

a powder input unit located at an outer side of the dissolution bath;

an impeller installed to be rotatable inside the dissolution bath; and an anchor located inside the dissolution bath and having a passage of the powder inputted by the powder input unit and at least one powder spouting hole connected to the passage, wherein the anchor includes: an upper frame connected to the powder input unit; a lower frame located below the upper frame; and a pair of connection frames configured to connect the upper frame and the lower frame; such that the upper frame, the lower frame, and the pair of connection frames form four sides of a rectangular frame shape.

2. The dissolution mixer according to claim 1, further comprising: a dissolved material discharging unit connected to a lower portion of the dissolution bath.

3. The dissolution mixer according to claim 1, wherein the at least one powder spouting hole is formed in the lower frame.

4. The dissolution mixer according to claim 3, wherein a center portion of the lower frame has a donut shape.

5. The dissolution mixer according to claim 4, wherein the at least one powder spouting hole is formed in both the center portion of the lower frame and a region of the lower frame other than the center portion.

6. The dissolution mixer according to claim 4, wherein the at least one powder spouting hole is formed only in the center portion of the lower frame.

7. The dissolution mixer according to claim 1, wherein the anchor is installed to be rotatable inside the dissolution bath.

8. The dissolution mixer according to claim 7, wherein a rotating direction of the anchor is identical to a rotating direction of the impeller.

9. The dissolution mixer according to claim 8, wherein a rotating speed of the anchor is slower than a rotating speed of the impeller.

10. The dissolution mixer according to claim 7, wherein the impeller rotates based on a rotation shaft and the anchor rotates based on the same rotation shaft.

* * * * *